US008453878B2

(12) United States Patent
Palmquist

(10) Patent No.: US 8,453,878 B2
(45) Date of Patent: Jun. 4, 2013

(54) LIQUID LEVEL MEASURING DEVICE

(76) Inventor: Keith Palmquist, Moorpark, CA (US)

( * ) Notice: Subject to any disclaimer, the term of this patent is extended or adjusted under 35 U.S.C. 154(b) by 529 days.

(21) Appl. No.: 12/729,899

(22) Filed: Apr. 7, 2010

(65) Prior Publication Data

US 2011/0166699 A1 Jul. 7, 2011

Related U.S. Application Data

(60) Provisional application No. 61/292,472, filed on Jan. 5, 2010.

(51) Int. Cl.

| | |
|---|---|
| ***B67D 7/06*** | (2010.01) |
| ***B67D 7/24*** | (2010.01) |
| ***B67D 1/00*** | (2006.01) |

(52) U.S. Cl.

USPC ..... 222/23; 222/30; 222/43; 222/64

(58) Field of Classification Search

USPC ..... 222/23, 30, 36, 31, 41, 43, 64, 65, 222/66; 73/301, 305, 313, 314; 700/236; 340/612, 618

See application file for complete search history.

(56) References Cited

U.S. PATENT DOCUMENTS

| | | | | |
|---|---|---|---|---|
| 3,170,597 | A * | 2/1965 | Reichenberger | 222/36 |
| 3,181,729 | A * | 5/1965 | Milonas et al. | 222/36 |
| 4,265,370 | A * | 5/1981 | Reilly | 222/25 |
| 4,436,223 | A * | 3/1984 | Wilson | 222/36 |
| 5,255,819 | A * | 10/1993 | Peckels | 222/1 |
| 5,318,197 | A * | 6/1994 | Martindale et al. | 222/1 |
| 5,379,916 | A * | 1/1995 | Martindale et al. | 222/1 |
| 5,505,349 | A * | 4/1996 | Peckels | 222/641 |
| 5,507,411 | A * | 4/1996 | Peckels | 222/1 |
| 6,036,055 | A * | 3/2000 | Mogadam et al. | 222/23 |
| 6,409,046 | B1 * | 6/2002 | Peckels | 222/1 |
| 6,662,976 | B2 * | 12/2003 | Jensen et al. | 222/481.5 |
| 7,260,504 | B2 * | 8/2007 | Mogadam | 702/186 |
| 7,272,537 | B2 * | 9/2007 | Mogadam | 702/186 |
| 2003/0055589 | A1 * | 3/2003 | Mogadam | 702/100 |
| 2008/0272147 | A1 | 11/2008 | Buker et al. | |
| 2010/0038378 | A1 | 2/2010 | Gabler et al. | |

OTHER PUBLICATIONS http://www.liquormonitor.com/hardware.asp.

* cited by examiner

*Primary Examiner* — Kevin P Shaver
*Assistant Examiner* — Stephanie E Williams
(74) *Attorney, Agent, or Firm* — Edwin Tarver; Lauson & Tarver LLP

(57) ABSTRACT

A liquid level sensing and reporting system for bar keepers is proposed, having a liquid level sensor in wireless communication with a remote computer having software algorithms for calculating and reporting volume. The sensor is substantially in the form of a liquor bottle spout, and includes a means for measuring the height of the liquid in a bottle, sensing inversion of the spout, and sending the data wirelessly to a receiver. The receiver is associated with the computer, and transmits the data to the computer which calculates liquor volumes based on the changing height of the liquid in a bottle from pre-pour to post-pour status. The software extrapolates this information to produce a variety of real-time beverage consumption reports, including error reports caused by over pours, under pours, and skimming.

25 Claims, 13 Drawing Sheets

LIQUOR ALERT! DEVICES VARIANCE EXPORT

| CODE NO. | PRODUCT | LIQUOR TYPE | BOTTLE SIZE | VENDOR | |
|---|---|---|---|---|---|
| 546727846 | ABSOLUT 80 | VODKA | 750 ML | SOUTHERN WIME & SPIRITS | MAIN MENU |
| 856365895 | ABSOLUT 80 | VODKA | 1.0 L | SOUTHERN WINE & SPIRITS | |
| 467585646 | ABSOLUT 80 | VODKA | 1.75 L | SOUTHERN WINE & SPIRITS | PRODUCT MANAGER |
| 958648455 | ABSOLUT 100 | VODKA | 750 ML | SOUTHERN WINE & SPIRITS | |
| 452837956 | ABSOLUT 100 | VODKA | 1.0 L | SOUTHERN WINE & SPIRITS | |
| 253469878 | ABSOLUT 100 | VODKA | 1.75 l | SOUTHERN WINE & SPIRITS | DEVICE MANAGER |
| 123465987 | ABSOLUT 125 | VODKA | 750 ML | SOUTHERN WINE & SPIRITS | |
| 986542134 | ABSOLUT 125 | VODKA | 1.0 L | SOUTHERN WINE & SPIRITS | |
| 563869875 | ABSOLUT 125 | VODKA | 1.75 L | SOUTHERN WINE & SPIRITS | INVENTORY MANAGER |
| 754652364 | ABSOLUT CITRON | VODKA | 750 ML | SOUTHERN WINE & SPIRITS | |
| 639557638 | ABSOLUT CITRON | VODKA | 1.0 L | SOUTHERN WINE & SPIRITS | |
| 124365289 | ABSOLUT CITRON | VODKA | 1.75 L | SOUTHERN WINE & SPIRITS | PURCHASE MANAGER |
| 365978547 | ABSOLUT KURANT | VODKA | 750 ML | SOUTHERN WINE & SPIRITS | |
| 659567345 | ABSOLUT KURANT | VODKA | 1.0 L | SOUTHERN WINE & SPIRITS | |
| 956576543 | ABSOLUT KURANT | VODKA | 1.75 L | SOUTHERN WINE & SPIRITS | REPORT MANAGER |
| 132657967 | ABSOLUT PEACH | VODKA | 750 ML | SOUTHERN WINE & SPIRITS | |
| 134697857 | ABSOLUT PEACH | VODKA | 1.0 L | SOUTHERN WINE & SPIRITS | |
| 132467579 | ABSOLUT PEACH | VODKA | 1.75 L | SOUTHERN WINE & SPIRITS | DRINK MATRIX |
| 326497858 | ABSOLUT PEAR | VODKA | 750 ML | SOUTHERN WINE & SPIRITS | |
| 211134659 | ABSOLUT PEAR | VODKA | 1.0 L | SOUTHERN WINE & SPIRITS | |
| 100000021 | ABSOLUT PEAR | VODKA | 1.75 L | SOUTHERN WINE & SPIRITS | VARIANCE MANAGER |
| 635697887 | ABSOLUT RASBERRY | VODKA | 750 ML | SOUTHERN WINE & SPIRITS | |
| 100000023 | ABSOLUT RASBERRY | VODKA | 1.0 L | SOUTHERN WINE & SPIRITS | |
| 577752458 | ABSOLUT RASBERRY | VODKA | 1.75 L | SOUTHERN WINE & SPIRITS | IMPORT MANAGER |
| 100000025 | ABSOLUT TANGERINE | VODKA | 750 ML | SOUTHERN WINE & SPIRITS | |
| 764957277 | ABSOLUT TANGERINE | VODKA | 1.0 L | SOUTHERN WINE & SPIRITS | |
| 100000027 | ABSOLUT TANGERINE | VODKA | 1.75 L | SOUTHERN WINE & SPIRITS | CONFIGURATION MANAGER |
| 100000025 | ABSOLUT TANGERINE | VODKA | 750 ML | SOUTHERN WINE & SPIRITS | |
| 764957277 | ABSOLUT TANGERINE | VODKA | 1.0 L | SOUTHERN WINE & SPIRITS | |

*Fig. 4*

LIQUOR ALERT! DEVICES VARIANCE EXPORT

| SERIAL NUMBER | LIQUOR BRAND | STATUS | TIME | DATE | VENUE | 1 |
|---|---|---|---|---|---|---|
| 100000001 | ABSOULT | ACTIVE | 08:00:01 A.M. | 1/1/2009 | RESTAURANT BAR | |
| 100000002 | ABSOULT CITRON | ACTIVE | 08:01:01 A.M. | 1/1/2009 | RESTAURANT BAR | |
| 100000003 | ABSOULT MANGO | ACTIVE | 08:02:01 A.M. | 1/1/2009 | RESTAURANT BAR | |
| 100000004 | ABSOULT PEACH | INACTIVE | 08:03:01 A.M. | 1/1/2009 | RESTAURANT BAR | |
| 100000005 | ABSOULT PEACH | ACTIVE | 08:04:01 A.M. | 1/1/2009 | RESTAURANT BAR | |
| 100000006 | AMARETTO | ACTIVE | 08:04:01 A.M. | 1/1/2009 | RESTAURANT BAR | |
| 100000007 | BACARDI | ACTIVE | 08:05:01 A.M. | 1/1/2009 | RESTAURANT BAR | |
| 100000008 | BACARDI CITRON | ACTIVE | 08:06:01 A.M. | 1/1/2009 | RESTAURANT BAR | |
| 100000009 | BACARDI LIMON | ACTIVE | 08:07:01 A.M. | 1/1/2009 | RESTAURANT BAR | |
| 100000010 | BAILEY'S IRISH CREAM | ACTIVE | 08:08:01 A.M. | 1/1/2009 | RESTAURANT BAR | |
| 100000011 | BEEFEATER GIN | ACTIVE | 08:09:01 A.M. | 1/1/2009 | RESTAURANT BAR | |
| 100000012 | CHIVAS REGAL | ACTIVE | 08:11:01 A.M. | 1/1/2009 | RESTAURANT BAR | |
| 100000013 | CUTTY SARK | ACTIVE | 08:12:01 A.M. | 1/1/2009 | RESTAURANT BAR | |
| 100000014 | DEWARS | ACTIVE | 08:14:01 A.M. | 1/1/2009 | RESTAURANT BAR | |
| 100000015 | DRAUMBUI | ACTIVE | 08:15:01 A.M. | 1/1/2009 | RESTAURANT BAR | |
| 100000016 | GLENLEVIT | ACTIVE | 08:17:01 A.M. | 1/1/2009 | RESTAURANT BAR | |
| 100000017 | GORDONS | INACTIVE | 08:23:01 A.M. | 1/1/2009 | RESTAURANT BAR | |
| 100000018 | HENSLEY | ACTIVE | 08:25:01 A.M. | 1/1/2009 | RESTAURANT BAR | |
| 100000019 | JACK DANIELS | ACTIVE | 08:27:01 A.M. | 1/1/2009 | RESTAURANT BAR | |
| 100000020 | JONNIE WALKER BLACK | ACTIVE | 08:28:01 A.M. | 1/1/2009 | RESTAURANT BAR | |
| 100000021 | JONNIE WALKER GREEN | ACTIVE | 08:29:01 A.M. | 1/1/2009 | RESTAURANT BAR | |
| 100000022 | JONNIE WALKER RED | ACTIVE | 08:31:01 A.M. | 1/1/2009 | RESTAURANT BAR | |
| 100000023 | KELLER | ACTIVE | 08:34:01 A.M. | 1/1/2009 | RESTAURANT BAR | |
| 100000024 | KETLE ONE | ACTIVE | 08:36:01 A.M. | 1/1/2009 | RESTAURANT BAR | |
| 100000025 | KETLE ONE CITRON | ACTIVE | 08:41:01 A.M. | 1/1/2009 | RESTAURANT BAR | |
| 100000026 | KETLE ONE RASBERRY | ACTIVE | 08:42:01 A.M. | 1/1/2009 | RESTAURANT BAR | |
| 100000027 | KETLE ONE VANILLA | INACTIVE | 08:44:01 A.M. | 1/1/2009 | RESTAURANT BAR | |
| 100000028 | MYERS RUM | ACTIVE | 08:52:01 A.M. | 1/1/2009 | RESTAURANT BAR | |
| 100000029 | MALIBU RUM | ACTIVE | 08:56:01 A.M. | 1/1/2009 | RESTAURANT BAR | |

MAIN MENU
PRODUCT MANAGER
DEVICE MANAGER
INVENTORY MANAGER
PURCHASE MANAGER
REPORT MANAGER
DRINK MATRIX
VARIANCE MANAGER
IMPORT MANAGER
CONFIGURATION MANAGER

*Fig. 5*

LIQUOR ALERT! DEVICES VARIANCE EXPORT

| CODE NO | PRODUCT | TYPE | VENDOR | SIZE | OPEN STOCK | BACK | OH COST | ON | ON ORD |
|---|---|---|---|---|---|---|---|---|---|
| 100000001 | ABSOULT | VODKA | SOUTHERN | 750 ML | 13.02 OZ. | 1 | $22.50 | 2 | $18.00 |
| 100000002 | ABSOULT CITRON | VODKA | SOUTHERN | 750 ML | 11.98 OZ. | 5 | $75.00 | 3 | $22.00 |
| 100000003 | ABSOULT MANGO | VODKA | SOUTHERN | 750 ML | 2.00 OZ. | 4 | $68.00 | 1 | $16.00 |
| 100000004 | ABSOULT PEACH | VODKA | SOUTHERN | 750 ML | 8.55 OZ. | 8 | $48.95 | 5 | $54.00 |
| 100000005 | ABSOULT PEACH | VODKA | SOUTHERN | 750 ML | 13.02 OZ. | 6 | $57.00 | 6 | $21.00 |
| 100000006 | AMARETTO | VODKA | SOUTHERN | 750 ML | 7.02 OZ. | 5 | $99.85 | 2 | $23.00 |
| 100000007 | BACARDI | VODKA | SOUTHERN | 750 ML | 16.02 OZ. | 4 | $55.25 | 1 | $66.52 |
| 100000008 | BACARDI CITRON | VODKA | SOUTHERN | 750 ML | 13.02 OZ. | 2 | $36.25 | 3 | $18.95 |
| 100000009 | BACARDI LIMON | VODKA | SOUTHERN | 750 ML | 11.02 OZ. | 15 | $48.75 | 6 | $88.00 |
| 100000010 | BAILEY'S IRISH CREAM | VODKA | SOUTHERN | 750 ML | 13.02 OZ. | 12 | $95.35 | 5 | $44.00 |
| 100000011 | BEEFEATER GIN | VODKA | SOUTHERN | 750 ML | 23.02 OZ. | 1 | $66.25 | 4 | $32.00 |
| 100000012 | CHIVAS REGAL | VODKA | SOUTHERN | 750 ML | 19.02 OZ. | 4 | $88.90 | 2 | $55.00 |
| 100000013 | CUTTY SARK | VODKA | SOUTHERN | 750 ML | 23.02 OZ. | 0 | $0.00 | 11 | $48.00 |
| 100000014 | DEWARS | VODKA | SOUTHERN | 750 ML | 33.02 OZ. | 11 | $637.82 | 5 | $62.00 |
| 100000015 | DRAUMBUI | VODKA | SOUTHERN | 750 ML | 13.02 OZ. | 9 | $55.24 | 2 | $32.00 |
| 100000016 | GLENLEVIT | VODKA | SOUTHERN | 750 ML | 16.02 OZ. | 6 | $87.56 | 3 | $12.00 |
| 100000017 | GORDONS | VODKA | SOUTHERN | 750 ML | 16.06 OZ. | 5 | $39.62 | 1 | $33.00 |
| 100000018 | HENSEEY | VODKA | SOUTHERN | 750 ML | 13.02 OZ. | 4 | $55.24 | 2 | $23.00 |
| 100000019 | JACK DANIELS | VODKA | SOUTHERN | 750 ML | 19.62 OZ. | 2 | $55.24 | 1 | $2.00 |
| 100000020 | JONNIE WALKER BLACK | VODKA | SOUTHERN | 750 ML | 3.02 OZ. | 35 | $75.00 | 5 | $21.00 |
| 100000021 | JONNIE WALKER GREEN | VODKA | SOUTHERN | 750 ML | 13.02 OZ. | 1 | $68.00 | 4 | $35.00 |
| 100000022 | JONNIE WALKER RED | VODKA | SOUTHERN | 750 ML | 18.02 OZ. | 2 | $48.95 | 6 | $64.00 |
| 100000023 | KELLER | VODKA | SOUTHERN | 750 ML | 18.02 OZ. | 5 | $57.50 | 3 | $41.00 |
| 100000024 | KETLE ONE | VODKA | SOUTHERN | 750 ML | 8.02 OZ. | 4 | $99.85 | 2 | $23.00 |
| 100000022 | JONNIE WALKER RED | VODKA | SOUTHERN | 750 ML | 18.02 OZ. | 2 | $48.95 | 6 | $64.00 |
| 100000023 | KELLER | VODKA | SOUTHERN | 750 ML | 18.02 OZ. | 5 | $57.50 | 3 | $41.00 |
| 100000024 | KETLE ONE | VODKA | SOUTHERN | 750 ML | 8.02 OZ. | 4 | $99.85 | 2 | $23.00 |
| SELECT ANY ITEM TO VIEW RECENT AND LIVE TRANSACTIONS | | | | | 1536 OZ | 232 | $3,252.00 | 84 | $5,252.00 |

MAIN MENU
PRODUCT MANAGER
DEVICE MANAGER
INVENTORY MANAGER
PURCHASE MANAGER
REPORT MANAGER
DRINK MATRIX
VARIANCE MANAGER
IMPORT MANAGER
CONFIGURATION MANAGER

*Fig. 6*

LIQUOR ALERT! DEVICES VARIANCE EXPORT

| VENDOR | DEPT TYPE | PRODUCT INFORMATION | | OPEN BOTTLES | BOTTLE STOCK | AUTO ORDER | OVERRIDE AUTO | COST | QTY RECEIVED | TOTAL COST |
|---|---|---|---|---|---|---|---|---|---|---|
| SOUTHERN | VODKA | ABSOLUT 80 | 546727846 | 12.02 OZ | 3 | 2 | | $66.00 | 2 | $66.00 |
| SOUTHERN | VODKA | ABSOLUT CITRON | 856365895 | 11.04 OZ | 1 | 5 | 7 | $323.00 | 7 | $323.00 |
| SOUTHERN | VODKA | KETEL ONE | 467585646 | 9.04 OZ | 2 | 3 | | $66.00 | 3 | $66.00 |
| SOUTHERN | SCOTCH | DEWERS | 100000005 | 6.75 OZ | 5 | 0 | | $0.00 | 0 | $0.00 |
| SOUTHERN | SCOTCH | CHIVAL REGAL | 856365895 | 19.82 OZ | 0 | 4 | 5 | $68.00 | 5 | $68.00 |
| SOUTHERN | SCOTCH | CUTTY | 100000007 | 33.00 OZ | 0 | 4 | | $56.00 | 4 | $56.00 |
| SOUTHERN | LIQUORS | BAILEYS IRISH CREAM | 100000008 | 33.00 OZ | 8 | 0 | 2 | $23.00 | 2 | $23.00 |
| SOUTHERN | LIQUORS | EMMETS | 100000008 | 31.00 OZ | 7 | 0 | 2 | $56 .00 | 2 | $56.00 |
| SOUTHERN | LIQUORS | OUZO | 100000009 | 27.08 OZ | 6 | 0 | 3 | $0.00 | 3 | $0.00 |
| SOUTHERN | LIQUORS | SAMBUCO | 856365895 | 19.74 OZ | 2 | 3 | | $87.00 | 3 | $87.00 |
| SOUTHERN | TEQUILA | PATRON SILVER | 100000012 | 27.00 OZ | 3 | 3 | | $56.00 | 3 | $56.00 |
| SOUTHERN | TEQUILA | CASIDORES | 100000008 | 13.76 OZ | 4 | 2 | 5 | $78.00 | 5 | $78.00 |
| SOUTHERN | RUM | MEYERS RUM | 100000009 | 14.00 OZ | 4 | 3 | 5 | $98.00 | 5 | $98.00 |
| SOUTHERN | RUM | MALIBU RUM | 856365895 | 19.98 OZ | 5 | 2 | 5 | $54.00 | 5 | $54.00 |
| | | | | | | 32 | 18 | $ 689.50 | 50 | $689.50 |

MAIN MENU
PRODUCT MANAGER
DEVICE MANAGER
INVENTORY MANAGER
PURCHASE MANAGER
REPORT MANAGER
DRINK MATRIX
VARIANCE MANAGER
IMPORT MANAGER
CONFIGURATION MANAGER

*Fig. 8*

LIQUOR ALERT! DEVICES VARIANCES EXPOT

| DRINK NAME | PRIMARY INGREDIENT | OZ'S | SECONDAYRY INGREDIENT | OZ'S | THIRD INGREDIENT | OZ'S | FOURTH INGREDIENT | OZ'S |
|---|---|---|---|---|---|---|---|---|
| ALABAMA | WHISKEY | 1.5 | SCOTCH | 0.5 | SOUR MIX | 1.5 | ORANGE JUICE | 0.5 |
| ADIOS | SCOTCH | 1.5 | VODKA | 0.5 | PALM JUICE | 1.5 | SOUR MIX | 0.2 |
| BAILEY'S & COFFEE | LIQUORS | 1.5 | COFFEE | 1.5 | | | | |
| COSMO | VODKA | 1.5 | TRIPLE SEC | 0.5 | CRANBERRY | 0.5 | | |

MAIN MENU

PRODUCT MANAGER

DEVICE MANAGER

INVENTORY MANAGER

PURCHASE MANAGER

REPORT MANAGER

DRINK MATRIX

VARIANCE MANAGER

IMPORT MANAGER

CONFIGURATION MANAGER

*Fig. 10*

LIQUOR ALERT! DEVICES VARIANCES EXPOT

| LIQUOR ALERT! POURS | DATE | TIME | OUNCES POURED | MATCH | POS DRINK SALE | DATE | TIME |
|---|---|---|---|---|---|---|---|
| ABSOLUT | 1/1/2009 | 8:15 PM | 1.8 | | ABSOLUT | 1/1/2009 | 8:16 PM |
| BEEFEATER | 1/1/2009 | 8:16 PM | 1.7 | | BEEFEATER | 1/1/2009 | 8:20 PM |
| BAILEYS | 1/1/2009 | 8:20 PM | 2.2 | | BAILEYS | 1/1/2009 | 8:25 PM |
| DEWERS | 1/1/2009 | 8:25 PM | 2.1 | | DEWERS | 1/1/2009 | 8:30 PM |
| VODKA | 1/1/2009 | 8:30 PM | 2.3 | | COSMOPOLITAN | 1/1/2009 | 8:32 PM |
| GRAN MARNIER | 1/1/2009 | 8:30:35 PM | 0.75 | | | | |
| CRANBERRY | 1/1/2009 | 8:50:58 PM | 0.05 | | | | |
| PATRON SILVER | 1/1/2009 | 9:00 PM | 2.78 | | | | |
| DON JULIO | 1/1/2009 | 9:12 PM | 2.24 | | DON JULIO | 1/1/2009 | 9:15 PM |

MAIN MENU
PRODUCT MANAGER
DEVICE MANAGER
INVENTORY MANAGER
PURCHASE MANAGER
REPORT MANAGER
DRINK MATRIX
VARIANCE MANAGER
IMPORT MANAGER
CONFIGURATION MANAGER

*Fig. 11*

LIQUID LEVEL MEASURING DEVICE

This application claims the benefit of the filing date of provisional application No. 61/292,472, filed on Jan. 5, 2010.

BACKGROUND

Monitoring the volume of beer, wine and liquor decanted by bartenders in dram shops to prevent skimming and other theft is known in the art. Various devices in the current art have been developed to automatically limit and/or record the volume of liquid decanted from specific liquor bottles. Devices in the current art, however, are prone to error, may be easily modified to avoid theft detection, and adversely affect the relationship between bar tenders and customers.

The present invention is therefore drawn to an improvement in the art of liquid measurement and monitoring, and particularly to a device for accurately measuring and monitoring liquor sales. In particular, the invention is drawn to an apparatus for accurately gauging beverage container liquid level change and reporting it to a remote computer for calculation as bartenders decant liquids, correlating individual bottles to beverage type, and reporting volume errors based on prior bottle volumes and cash register data, while still permitting bar tenders to determine individual pour volumes. These and other objects of the invention will be further developed in the appended summary, description and claims.

SUMMARY

The present invention is directed to an apparatus and process satisfying the need for accurate liquor measurement, particularly in a bar setting. The invention includes a liquid measuring device having a liquid level sensor or probe for ascertaining the position of a liquor bottle liquid level. Also included in the device is a transmitter associated with the sensor, adapted to wirelessly transmit liquid level data from the sensor to a remote computer. The sensor device includes a spout for decanting liquid, and a means for detecting when the spout is inverted.

Software installed on the computer receives liquid level data, translating it into volume data and processes the information using algorithms to establish for one or more vessels, a first "pre-pour" volume and a second "post-pour" volume. The pre and post pour volumes are used to calculate the quality of liquid decanted from a bottle during pour events, and more importantly, allow the software to recognize anomalies or volume errors. Instances of anomalous pour events include the following examples: a bottle is inverted and the liquid level doesn't change; a bottle upon re-inversion has not been inverted and the liquid level changes. Other examples, including liquid change correlation with point of sale data are anticipated.

Additional embodiments of the invention include a memory and transfer device for wirelessly transmitting pour data to a remote computer or receiver/transmitter that can then forward the data to a computer for software processing. The spout may also include liquor type-identifying indicia, and a programmable viewing screen. In one embodiment, the spout may comprise an accelerometer to determine its orientation.

In additional embodiments of the spout, it is anticipated that the sensor may be a float-type sensor, capacitance sensor or optical sensor. Movement sensing and spout orientation may be accomplished by an Accelerometer, MEMs Gyroscope or similar sensor. Preferably the spout has an input for programming the spout.

For the software to generate reports, it must correlate a first set of volume data, the "pre-pour" and "post-pour" data from a spout with a second set of data based on the size and contents of a particular bottle. Container size information, liquor description, product brand, code, and vendor identifiers may also be included in the second set of data. Using predetermined formulas to calculate vessel volume with volume change data, vessel volume change information can be delivered in real time as bottles are decanted.

In addition to calculating volume data, the software program includes the ability to correlate data from the spout to identify multiple pours in cases where liquor is decanted into multiple glasses with a single inversion. The multiple pour data is used to ascertain the total number of continuous pours on a per bottle basis allowing it to suggest possible drink combinations. At any time, when the inventory program detects a data anomaly falling outside a predetermined set of pour parameters, it will generate an error report.

In addition to the pour volume data and vessel size data, the software is also programmed with an inventory function. The program stores individualized inventory data and automatically triggers a re-order event when inventory reaches a predetermined level. In various embodiments of the invention, the re-order event may range from a simple warning to contact a particular supplier, or the software may be programmed to automatically contact a supplier electronically and re-order a predetermined quantity of product.

It is anticipated that the software will interface with and receive sales data from point of purchase machines, including cash registers. Each spout at a particular station, it is anticipated, will be associated with the station's point of sale device. In the case of mixed drinks, the software program interfaces with the point of sale machine, translating individual pour data into combination pour data and suggesting likely combinations according to a predetermined list of mixed drinks.

By interfacing with point of sale devices, sensor anomalies generated by the software can be correlated to point of sale anomalies. In this manner, the system can identify instances where an error occurred. For instance, it may identify instances where the wrong key on the point of sale device was input, or instances where the wrong product was served or used to create a mixed drink. The software allows users to see time-based transaction histories of pour and point of sale data so that persons responsible for the error and the time of the error can be easily correlated. If a user wishes to examine a particular transaction history range, the software is capable of displaying the information without affecting real time pour data collection.

It is anticipated that individual pour spouts will be programmed to activate or reset upon the occurrence of a predetermined activation event. In this manner, when the system is initially set up, and as new inventory is opened, the software program will maintain an accurate record of total inventory, pour data and errors. By manipulating the pre and post-pour data, the software program may generate various reports, including pour to drink correlation, pour to bartender correlation, pour to time correlation, pour to point of sale correlation, and open bottle pour to inventory levels.

These and other features, aspects, and advantages of the present invention will become better understood with regard to the following description, appended claims, and accompanying drawings where:

BRIEF DESCRIPTION OF THE FIGURES

FIG. 4 shows the products screen of the liquid level measuring software of the present version of the invention.

FIG. 5 shows the device programming screen of the liquid level measuring software of the present version of the invention.

FIG. 6 shows the inventory manager screen of the liquid level measuring software of the present version of the invention.

FIG. 8 shows the purchase manager screen of the liquid level measuring software of the present version of the invention.

FIG. 10 shows the drink matrix screen of the liquid level measuring software of the present version of the invention.

FIG. 11 shows the variance manager screen of the liquid level measuring software of the present version of the invention.

DESCRIPTION

Figure 1:
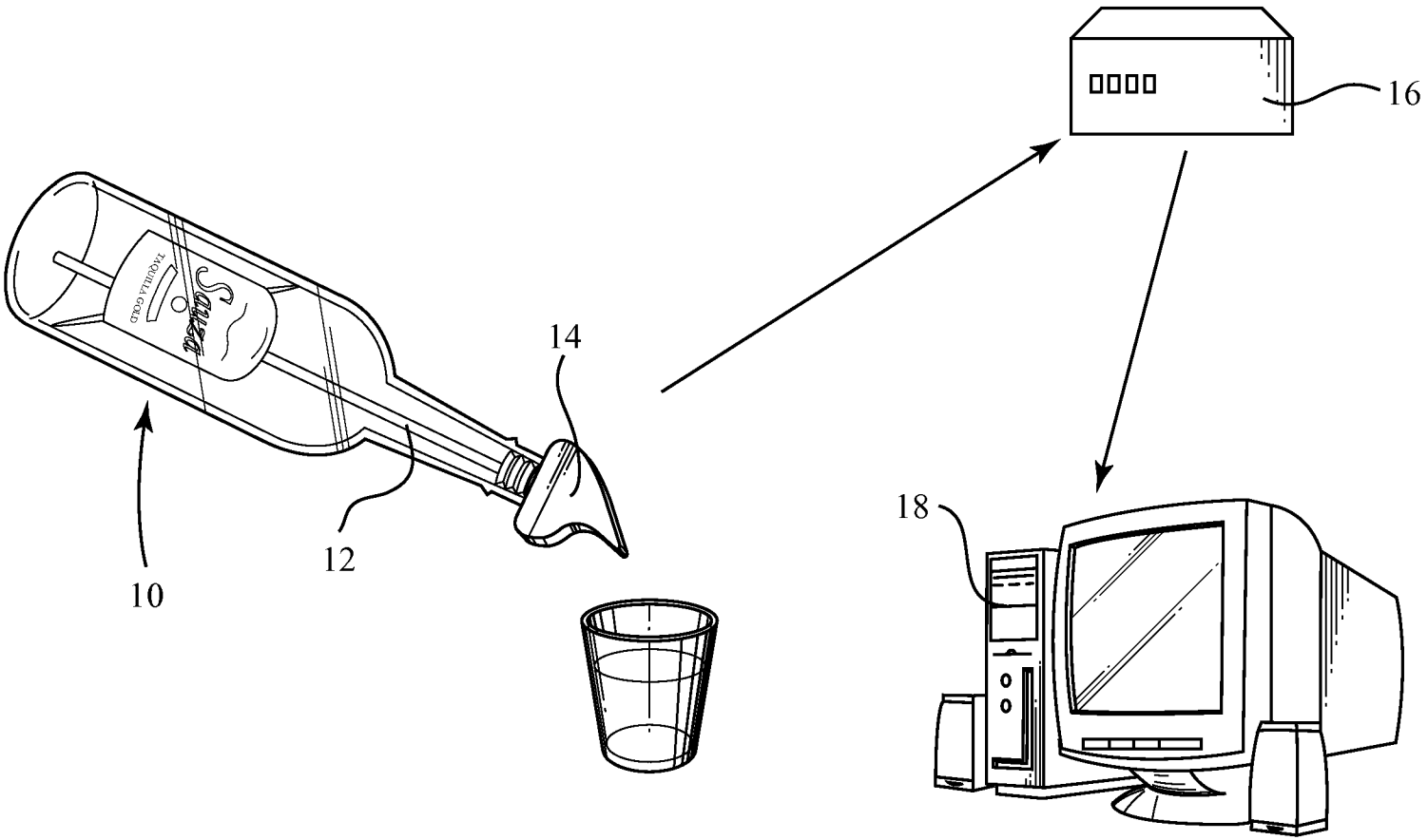
FIG. 1 is a diagram of a liquid level measuring device according to the present version of the invention.

Referring to FIG. 1, a liquor pour spout 10, having a probe sensor 12 for quantifying the liquid level in a liquor bottle, and a transmitter 14 for transmitting liquid level information is inserted into a liquor bottle. The probe sensor 12 measures the liquid level in the bottle and communicates the information to the transmitter 14. A relay 16 receives the liquid level information from the pour spout, and transmits the data, as well as individually identifying the pour spout from which data was received, to the back office computer 18. The back office computer 18 extrapolates the data from individual pour spouts and compares it to previously received data to establish a per-pour volume record for each pour spout.

Figure 2:
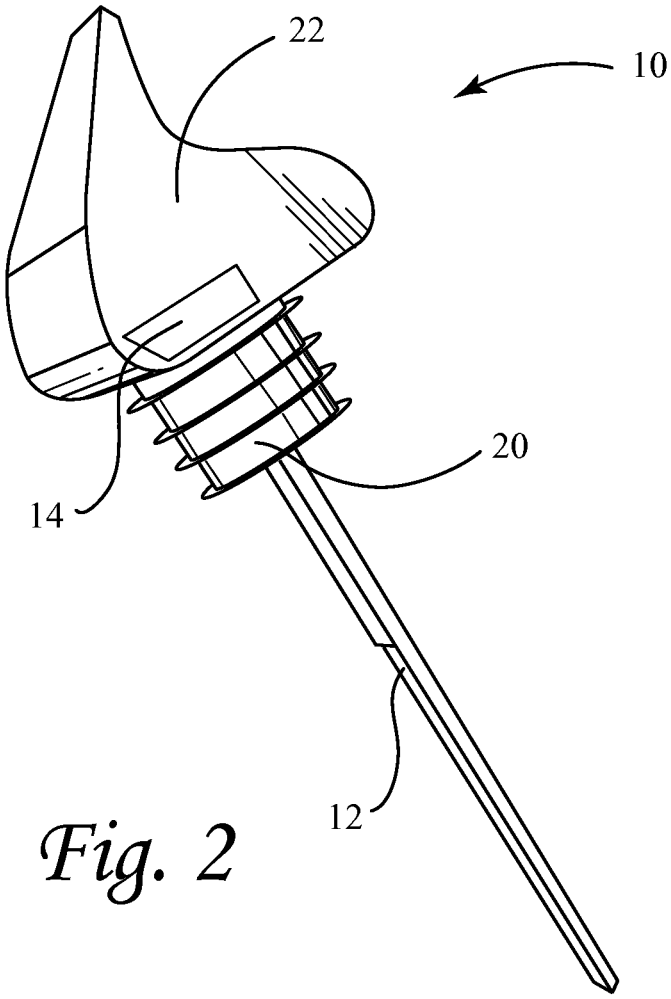
FIG. 2 is a perspective view of the pour spout of the liquid level measuring device according to the present version of the invention.

Referring to FIG. 2, the pour spout 10 comprises structures typically associated with conventional pour spouts. A collar 20 for sealing liquids in a bottle, and an air vent 22 allows air to replace liquid as the bottle is emptied. Unlike conventional pour spouts however, the pour spout 10 has a probe sensor 12 and transmitter 14 for sending liquid level information wirelessly away from the spout 10.

Preferably, the spout 10 is battery powered and capable of storing data in a memory for a predetermined period of time prior to data transmission, however Radio Frequency Identification (RFID) versions are also anticipated. Associating an RFID with each bottle as it goes into inventory, or as a part of the labeling process, enables real-time inventory control and tracking.

RFID devices, or "tags," usually consist of an integrated circuit for storing and processing information and processing transmitted and received radio frequency signals. They may be active, associated with a power source, or passive, stimulated by an external RF signal. By associating a unique RFID with each piece of inventory, the system can continually scan the inventory and detect, in real-time, when an item is removed or missing from inventory storage. At any time, therefore, an owner will know exactly how many bottles are in inventory and what types of bottles they are. By combining the level sensing technology of the present invention with RFID inventory maintenance, the system can automatically update and remove consumed bottles from inventory.

Since RFID tags are very small, they may be easily imbedded in stickers or labels applied to bottles. By virtue of a unique identifier, such as an Internet Protocol address, users may track individual bottles. Indicia in which RFID tags are embedded may also bear imprinted bar codes allowing users to physically scan indicia into the inventory control system in tandem with automatic activation. Users can also scan a bottle's original bar code at the same time, thereby providing specific product information (liquor type, brand, etc.) to the system. By correlating product information with RFID tag information, the system can automatically track liquor sales from entry into inventory to consumption.

Each spout may be assigned a unique Internet Protocol (IP) address. By associating individual spouts with individual IP addresses, the spouts in the system can comprise a network and individual spouts may be monitored by a host computer. In this manner, messages can be sent or received between one or more host computers and the individual spouts. Network messages using IP addresses may be wired or wireless, and since the IP system is standard in the computer industry, the spouts may take advantage of industry infrastructure, including specifications, products and integrated circuits, among others.

In various contemplated embodiments, it is anticipated that the transmitter 14 has a memory capacity for storing and transmitting data. Additionally, the spout may have a programmable viewing screen for displaying the type of liquor contained in the bottle attached to the spout, including the brand name, or other indicia. In another embodiment, the spout comprises an inversion sensor, such as an accelerometer, to sense bottle inversion.

The software associated with each spout accepts transmitted spout data and correlates a first set of volume data to a second set of data each time the spout is inverted and the liquid level in the bottle changes. The second set of data corresponds to the size and contents of a vessel, and comprises information of a type chosen from the list of container size, liquor description, product brand, product code and vendor information.

Using predetermined algorithms, the inventory program uses volume data to calculate and deliver vessel volume change information in real time to the software and thereby to an end user. The inventory program correlates data from the spout to ascertain the total number of continuous multiple pours by virtue of the pour data received from the sensor probe. In this manner, individualized error reports for data anomalies occurring outside a predetermined set of volume-per-pour parameters can be provided. In addition to reporting errors, the inventory program also stores individualized inventory data and causes a re-order event at individual predetermined inventory levels.

The inventory program receives sales data from a point of sale machine associated with a vessel. By interfacing with a point of sale machine, the software correlates individual pour data to combination pour data, and suggests likely individual pour events based on a predetermined set of data combinations. Anomalies from sensors are correlated to anomalies from points of sale. The inventory program generates time-based transaction histories associated with pour data and point of sale data. users may switch from real-time transaction monitoring to view transaction histories without affecting data collection.

A spout transmits activation data upon the occurrence of a predetermined activation event. The first set of data and second set of data may be manipulated in individualized data fields to generate reports including correlating pours to drinks, pours to bartenders, pours to time, pours to point of sale transaction, and pours to inventory open bottle level.

The sensor is preferably a type chosen from the list of float sensor, capacitance sensor and optical sensor. An accelerometer or a micro-electro-mechanical (including piezoelectric/piezoceramic) gyroscope is used to sense horizontal and vertical spout orientation. The inventory program calculates and reports the volume of liquid poured and existing inventory in real time, and the spouts comprise inputs for programming them according to inventory.

Figure 3:
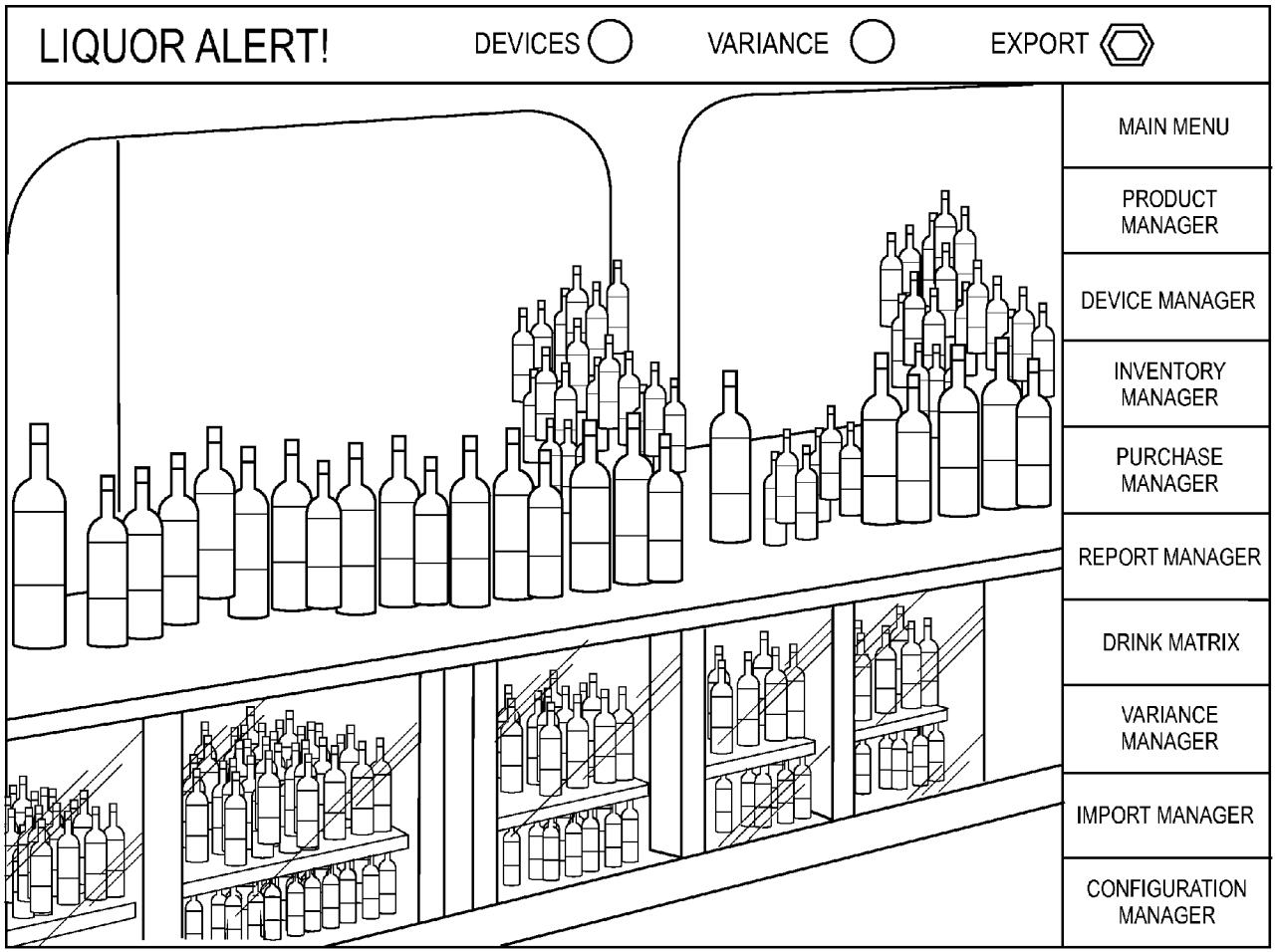
FIG. 3 shows the main screen of the liquid level measuring software of the present version of the invention.

Referring to FIG. 3, a start screen for a device user interface is shown. The computer receives transmissions of data from pour spouts and interprets the data into spout-specific volume data according to software algorithms. the inventory program uses liquid volume data to establish for individual bottles a first "pre-pour" volume, a second "post-pour" volume, and using this data calculates a third volume comprising the difference between the pre-pour and post pour volumes. The software then ascribes the information to a particular pour spout and can therefore identify a particular bartender.

Still referring to FIG. 3, specific activities governed by the software can include: product management, device management, inventory management, purchase management, report management, a drink matrix, variance management, import management and a configuration manager. Each of these functions will now be discussed Referring to FIG. 4, a product management screen is shown and described. The product management function tracks various types of liquor brands. For each liquor type and brand, the software identifies the product code number, product brand, liquor type, bottle sizes stocked by an individual user, and the vendor supplying the product in question. Since the software is preferably pre-loaded with most common liquor types, new products brought into inventory can be easily added to the database.

Referring to FIG. 5, A device manager screen is shown and described. The device manager is used to assign a specific size and type of liquor bottle to an individual pour spout. Preferably, when establishing the system, spouts are individually inverted and assigned unique serial number identifiers. With a serial number assigned, a user selects the liquor type and container size. A status field indicates whether or not a spout is active, and displays the date and time of activation. A "venue" field allows users to indicate the specific area in which a spout is used, such as a restaurant bar, lounge or other area, and each entry comprises a status bar field to indicate when a pour has resulted in an error.

Referring to FIG. 6, the inventory manager screen is shown and described. Since pour spouts are capable of establishing and maintaining a liquor level record for individual bottles, and are also capable of detecting pour errors, the system can be used as an inventory manager capable of maintaining liquor inventories in real time. The inventory manager screen shows products according to their code number, liquor type, vendor and size. In addition, open stock levels, backstock inventories, overhead cost, products on order and order cost are calculated.

The inventory manager allows users to perform a one-time inventory count for sealed back stock. Once the back stock information is combined with the open stock measurements from the pour spouts, inventory is constantly monitored to the $10^{th}$ of an ounce per product. As new products arrive, they can be scanned for automatic updating. The ability to track backordered inventory also allows users to project costs based on inventory data.

Figure 7:
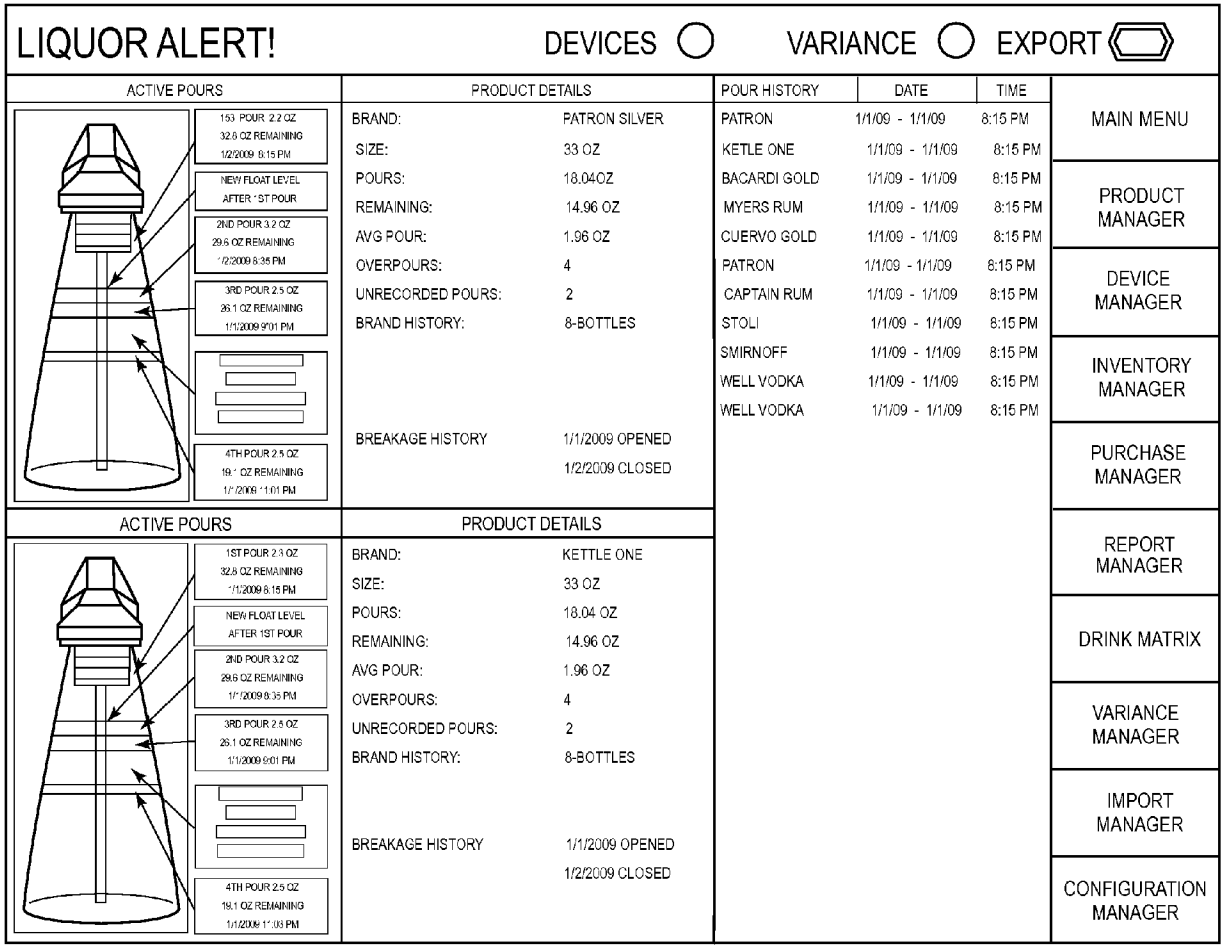
FIG. 7 shows the transaction history screen of the liquid level measuring software of the present version of the invention.

Referring to FIG. 7, a "live view" screen can be generated for all recent pours on the inventory manager page. Live views are provided for all bar locations, and selecting a pour log will display each bottle's historical pour path from full to empty. Also included in the live view screen is a feature that displays every brands' purchase and lifespan history, wherein each bottle can be recalled at any time to review its pour path and associated data.

Referring to FIG. 8, a purchase manager screen is shown and described. The purchase manager uses inventory data from the inventory manager to anticipate when re-orders will be necessary and enables users to set up automatic orders for types of liquor. Like the other screens, the purchase manager displays vendor, liquor type, brand and product code information. Additional fields are included for displaying open stock and bottles in inventory, and an auto-order function. The auto-order function causes the device to automatically send an order for additional product when inventory reaches a predetermined level. The screen displays the number of bottles on auto-order, the cost and an auto-order override button. Additional fields include quantities of product received as they are manually scanned in, and a total cost display for each liquor type.

Figure 9:
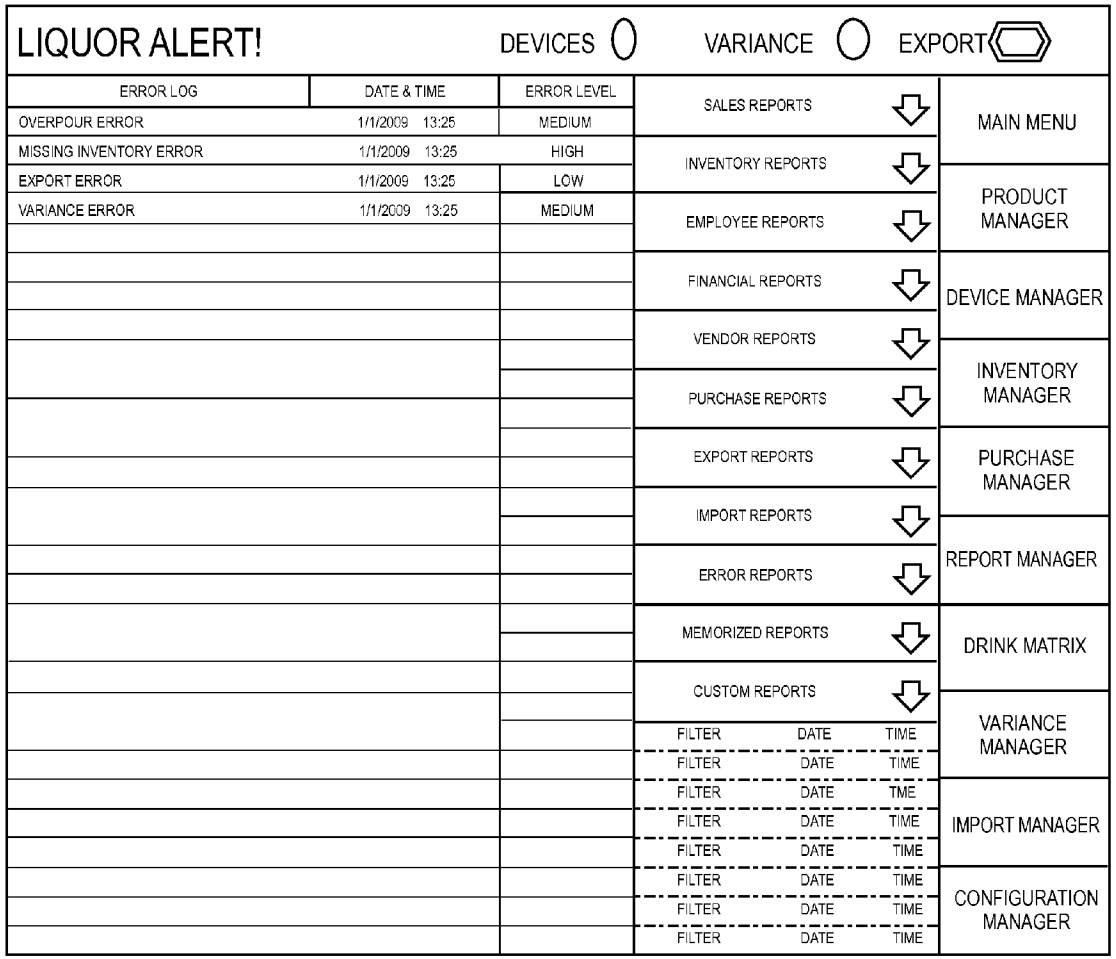
FIG. 9 shows the report manager screen of the liquid level measuring software of the present version of the invention.

Referring to FIG. 9, a report manager screen is shown and described. The report manager takes advantage of the pour calculations of the system to provide real time information regarding pour errors. Pour errors may be an over pour, missing inventory, an export error, or a variance error. The report manager is designed to work similar to anti-virus software in that it monitors data in real time to generate an error report immediately upon receiving erroneous data. In addition, an error level field is provided to establish the severity of an error. For instance a minor over pour might be assigned a low or medium level of severity, while a missing inventory error would be assigned a high level of severity.

In addition to the error reports, traditional reports are generated from the report manager, including sales reports, inventory reports, employee reports, financial reports, vendor reports, purchase reports, export reports, import reports, error reports, memorized reports, and custom reports. Reports may be filtered according to their fields.

Referring to FIG. 10, a drink matrix screen is shown and described. The drink matrix allows multiple ingredients to be easily programmed into a single mixed drink product that can be identified through the variance manager and import manager. The software comes pre-loaded with common mixed drinks identified and additional combinations can be easily added by users as they arise. The drink matrix displays the drink name, its primary, secondary, tertiary and quaternary ingredients and the necessary volumes for each.

Referring to FIG. 11, a variance manager screen is shown and described. In addition to its own internal calculations, it is anticipated that the software will also integrate with point of sale machinery in order to match cash register input with spout data. The variance manager exploits this feature by analyzing drinks poured compared to drinks processed in a point of sale (POS) system. The POS data imported into the software confirms pours. Referring to the sample data, four individual shots of liquor are recorded with the date and time of the pour and ounces poured. For each of these first four transactions, the data can be matched to a POS drink sale by correlating the liquor type, date and time of sale. The fifth sixth and seventh pours are recorded by the system from pour spout information, and the system correlates these pours to coincide with a drink comprising three pours of the type recorded by the system. Since the mixed drink, in this case a Cosmopolitan, comprises vodka, Gran Marnier and cranberry, the system correlates the mixed drink to the pours based on the similarity of ingredients and optionally the time of the pours versus time of sale. The eighth pour, recorded by the pour spouts has no corresponding POS data. Therefore the system perceives this as an error and reports it with an indicator to the user. By using the variance manager, the system avoids generating errors from drinks using multiple liquors or mixers.

Figure 12:
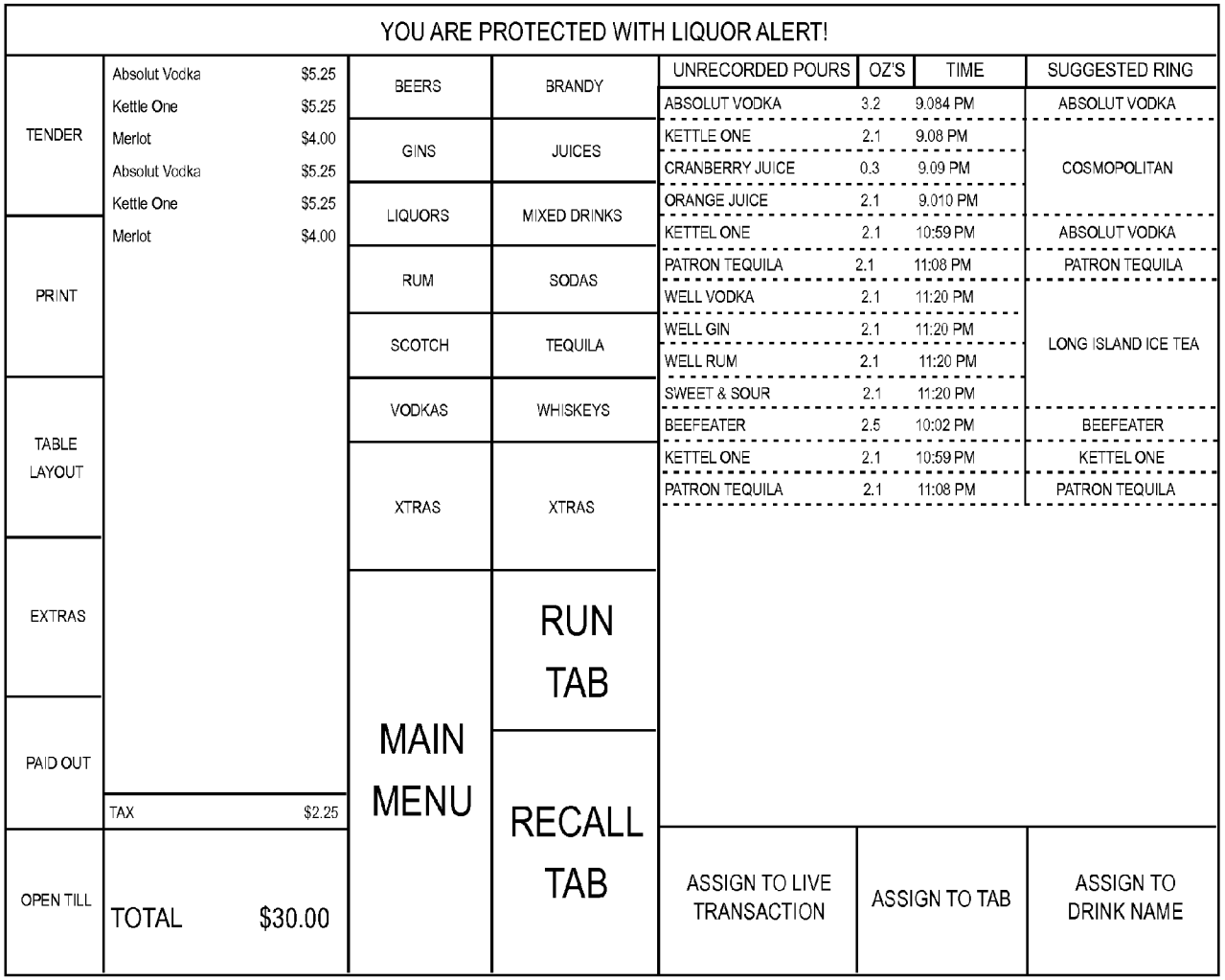
FIG. 12 shows the export manager screen of the liquid level measuring software of the present version of the invention.

Referring to FIG. 12, an export manager screen is shown and described. The export manager is works similar to the variance manager in that it interfaces with a third party POS system. The export manager is the screen used by bartenders or other employees when entering drinks into the POS system. In the system, each pour is first selected by staff and added to an open ticket. If any pours remain at the end of the evening, then it will become apparent staff made an error. In the sample data, several unreported pours are noted, and based on the timing of the pour and ingredients, potential mixed drinks are suggested.

Figure 13:
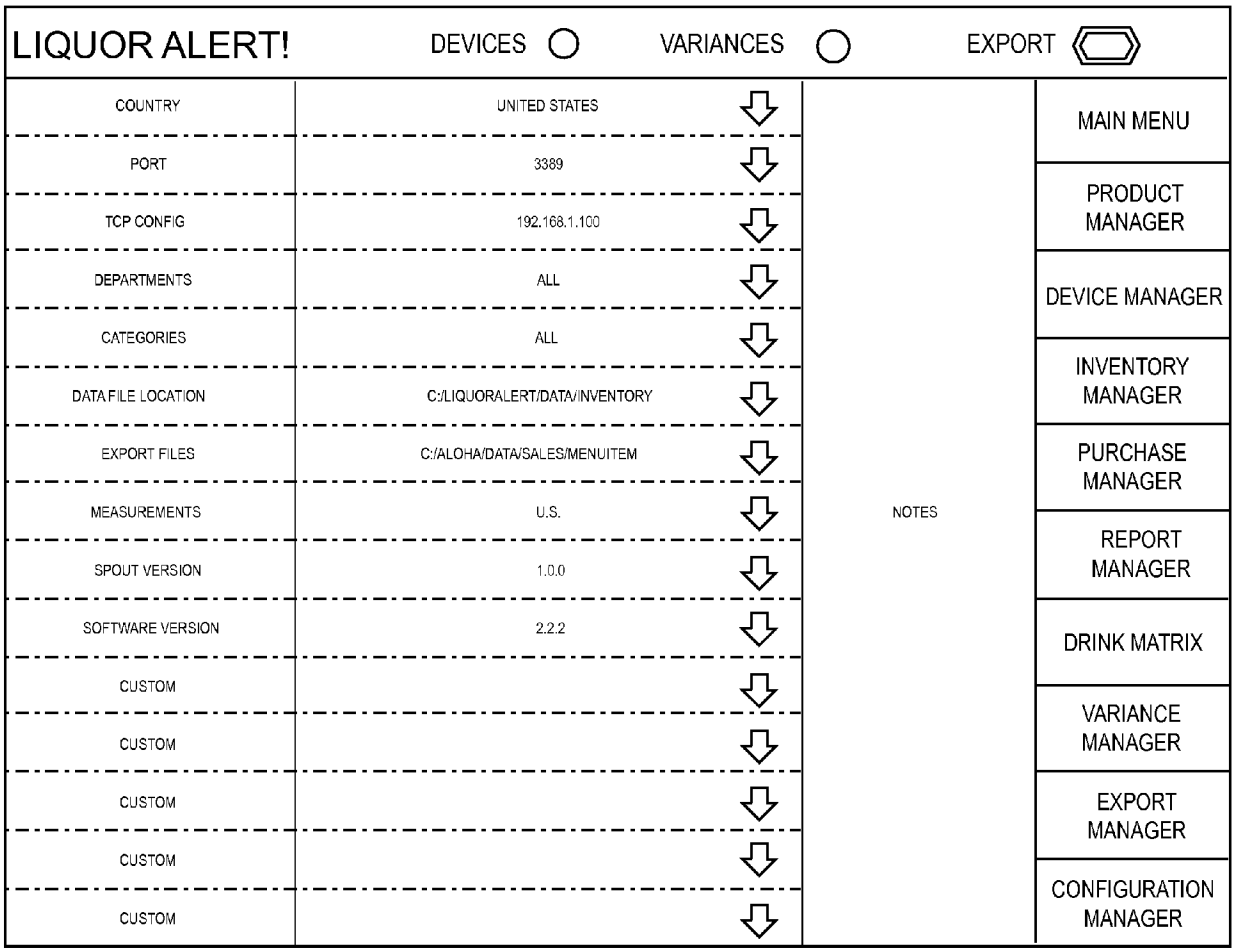
FIG. 13 shows the configuration manager screen of the liquid level measuring software of the present version of the invention.

Referring to FIG. 13, a configuration manager incorporated into the software allows users to customize the software for specific installations. Location information including country and measurement units allow the system to be installed in a variety of locations, communications protocol information including port, TCP configuration, data and export file locations are also included. Departments and categories are included to permit or exclude data sharing, and spout and software versions report the spout model and software revision used by the system. Fields are also included for notes specific to a particular user.

Although the present invention has been described in considerable detail with reference to certain preferred versions thereof, other versions are possible. For example, liquid level data may be obtained by a device other than the probe disclosed herein, and the software may operate on a system lacking a central computer. Therefore the spirit and scope of the appended claims should not be limited to the description of the preferred versions contained herein.

The reader's attention is directed to all papers and documents which are filed concurrently with this specification and which are open to public inspection with this specification, and the contents of all such papers and documents are incorporated herein by reference. All features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A liquid measuring and monitoring device for reporting container volume to a digital computer, comprising:

a means for sensing a liquid level in the container at rest, and for sensing partial or total inversion of the container;

a transmitting device associated with said level sensing means;

said transmitting device in communication with the digital computer; and a converter capable of converting said level sensor data into volumetric data from the container.

2. The liquid measuring and monitoring device of claim 1 wherein the device is configured to be attached to, and pour liquor from, a conventional liquor bottle.

3. The liquid measuring and monitoring device of claim 2 further comprising attachment means to lockably secure the device to the neck of the liquor bottle.

4. The liquid measuring and monitoring device of claim 2 wherein said level sensor is a device for sensing acceleration, including inversion of said bottle, and comprises a battery for powering a transmitter reporting inversion of said bottle.

5. The liquid measuring and monitoring device of claim 2 wherein said level sensor comprises means for governing the amount of liquid dispensed from said bottle.

6. The liquid measuring and monitoring device of claim 4 further comprising memory for storing level sensor data.

7. The liquid measuring and monitoring device of claim 6 further comprising a display for displaying the level sensor data and identifying a type of liquor.

8. The liquid measuring and monitoring device of claim 4 wherein said level sensor comprises an accelerometer calibrated to measure motion in and orientation of said at least one bottle spout.

9. The liquid measuring and monitoring device of claim 4 wherein said level sensor comprises a MEMs gyroscope to measure motion and orientation of said bottle spout.

10. The liquid measuring device of claim 1 wherein the inventory program individually correlates pre-pour data with post-pour data to calculate volume change data.

11. The liquid measuring device of claim 1 wherein volume change data is calculated by correlating liquid level data with known dimensions of specific liquor bottles.

12. The liquid measuring device of claim 11 wherein the inventory program associates volume change data with data chosen from the list of container size, liquor description, product brand, product code and vendor information, using the identifying information of a particular level sensor.

13. The liquid measuring device of claim 1 wherein the inventory program calculates and presents volume change data in tandem with changing sensor data thereby providing volume change data in "real time."

14. The liquid measuring device of claim 1 wherein the inventory program recognizes commonly mixed liquor combinations and proposes likely combinations to a user when receiving commonly combined liquor data from individual sensors.

15. The liquid measuring device of claim 1 wherein the inventory program detects data anomalies representing pour errors in tandem with changing sensor data, and provides individualized error reports to a user in "real time."

16. The liquid measuring device of claim 1 wherein the inventory program stores inventory data for individual liquor types and generates a re-order alert at predetermined inventory levels based on sensor volume data.

17. The liquid measuring device of claim 1 wherein the inventory program interfaces with at least one point-of-sale register with which at least one sensor is associated.

18. The liquid measuring device of claim 17 wherein the inventory program correlates individual sensor data to mixed drink combination data, and suggests likely combinations to a bartender, thereby decreasing the likelihood of a point of sale error.

19. The liquid measuring device of claim 17 wherein the inventory program detects anomalies between sensor data and point of sale register data and produces an error report based on data anomalies.

20. The liquid measuring device of claim 19 wherein the inventory program generates time-based transaction histories associated with pour data and point of sale data.

21. The liquid measuring device of claim 1 wherein users may switch from real-time transaction monitoring to transaction history viewing without affecting ongoing data collection.

22. The liquid measuring device of claim 2 wherein the at least one spout transmits activation data upon the occurrence of a predetermined activation event.

23. The liquid measuring device of claim 1 wherein the inventory program correlates sensor data to produce individualized reports chosen from the list of pours to drinks, pours to bartenders, pours to time, pours to point of sale transaction, and pours to inventory open bottle level.

24. A method of measuring and monitoring liquid volume comprising the steps of:

obtaining a first volume measurement based on a first liquid level in a container of known volume;

detecting partial or total inversion of the container;

obtaining a second volume measurement based on a second liquid level in said container of known volume;

calculating the difference between the first liquid level and the second liquid level; and reporting the difference on a per-pour basis.

25. A liquid measuring and monitoring device for liquor bottles and reporting to a digital computer, comprising:

a removable liquor bottle spout comprising a sensor for detecting the liquid level in each said liquor bottle, an accelerometer for detecting inversion of said bottle, and an identifier for associating said bottle with a unique set of data;

a transmitting and receiving device, associated with said spout, capable of identifying said unique data and wirelessly transmitting and receiving said sensor and accelerometer data;

said transmitting device electronically connected to the digital computer, said computer capable of converting said level sensor data into volume data for said liquor bottle and applying mathematical algorithms to said volume data in real time as said volume data changes.

* * * * *